United States Patent [19]

Wilson et al.

[11] Patent Number: 4,979,340

[45] Date of Patent: Dec. 25, 1990

[54] MOBILE FOLDING CHORAL RISER

[75] Inventors: Keremit H. Wilson, Edina; Rollin D. Botts, Bloomington, both of Minn.

[73] Assignee: Sico Incorporated, Minneapolis, Minn.

[21] Appl. No.: 479,203

[22] Filed: Feb. 13, 1990

Related U.S. Application Data

[63] Continuation of Ser. No. 223,756, Jul. 27, 1988, abandoned, which is a continuation-in-part of Ser. No. 80,408, Jul. 31, 1987, abandoned.

[51] Int. Cl.[5] ..... E04H 3/12

[52] U.S. Cl. ..... 52/9; 182/113

[58] Field of Search ..... 52/9, 10, 110, 143, 52/183; 297/159; 182/99, 113

[56] References Cited

U.S. PATENT DOCUMENTS

| | | | |
|---|---|---|---|
| Re: 30,830 | 12/1981 | Wenger | 182/113 |
| 1,715,885 | 6/1929 | Annand et al. . | |
| 1,823,484 | 9/1931 | Blumenthal | 297/159 |
| 2,009,037 | 7/1935 | Wellerig . | |
| 2,061,235 | 11/1936 | Horn | 52/10 |
| 2,575,593 | 11/1951 | Peery . | |
| 2,588,783 | 3/1952 | Wetzel . | |
| 2,704,383 | 3/1955 | Berg | 108/99 |
| 2,780,506 | 2/1957 | Howe | 297/159 |
| 2,983,968 | 5/1961 | Wurn | 52/110 |
| 3,112,010 | 11/1963 | Mihalik | 182/113 |
| 3,250,345 | 5/1966 | Behr et al. . | |
| 3,282,378 | 11/1966 | Pierce . | |
| 3,747,706 | 7/1973 | Paine et al. . | |
| 3,747,708 | 7/1973 | Wenger et al. . | |
| 3,869,835 | 3/1975 | Mackintosh | 52/9 |
| 3,914,909 | 10/1975 | McNeal | 52/9 |
| 4,237,661 | 12/1980 | Adams, Sr. et al. . | |
| 4,361,991 | 12/1982 | Wiese . | |
| 4,611,439 | 9/1986 | Graham | 52/9 |

*Primary Examiner*—John E. Murtagh

*Attorney, Agent, or Firm*—Merchant, Gould, Smith, Edell, Welter & Schmidt

[57] ABSTRACT

A mobile folding choral riser includes a foldable frame having means for receiving a number of removable riser steps at progressively higher locations on the frame. Locking means are provided for releasably securing the steps to the framework. A guardrail is provided along the back of the riser, and the guardrail is pivotable to permit overlapping with the guardrails of other riser sections when a riser in forward configuration (widest step at the back) is placed adjacent a riser section in reverse configuration (narrowest step at the back). Interlocks are provided for securing adjacent riser sections together, regardless of whether individual sections are in forward or reverse configuration. The riser can be folded between transport and operational configurations with locking or holding mechanisms for each configuration.

20 Claims, 11 Drawing Sheets

MOBILE FOLDING CHORAL RISER

This is a continuation, of application Ser. No. 07/223,756, filed July 27, 1988, now abandoned which in turn is a continuation-in-part of U.S. patent application Ser. No. 080,408, filed on July 31, 1987, now abandoned.

FIELD OF THE INVENTION

This invention pertains to the field of portable risers as are generally used in performances by singing groups and the like, to arrange different rows of the performer at different heights. In particular, the invention pertains to improvements in mobile, folding risers that can be quickly set up for use in a variety of different arrangements, and which can be quickly folded up and moved away for storage.

BACKGROUND OF THE PRIOR ART

Choral risers are used in theatres, schools, auditoriums, and the like for presenting performances by singing groups. Usually the need for the risers is temporary, as the stage or auditorium is used for multiple purposes. Risers therefore have been developed which consist of a number of sections which can be placed side-by-side to make as large a riser as is needed for a particular performance, and which sections can be disassembled or folded and moved to a storage area when not needed. Of course, efficiency in assembly and disassembly is an important feature for a riser of this type, as is stability of the riser in its use configuration. Various types of risers have been developed in the prior art, although none completely meet this need.

It is customary to provide a riser setup on a stage with a straight center portion and side portions which angle inwardly toward the director or audience. In order to provide flexibility in accommodating different singing group sizes, it is desirable to have a single type of stage section which can be easily adapted to straight line side-by-side relationship with another section, or to angled relationship to another section. This is generally accomplished by providing riser steps of different widths and with angled sides, and providing means for changing positions of the steps on the riser. In one orientation, referred to herein as the forward orientation, the widest step is at the top position at the back of the section and the narrowest step is at the front at the lowest position, so that the riser section forms a generally trapezoidal shape, narrowing towards the front. In a reverse orientation, the narrowest step is at the top and the widest is at the front, so that the orientation of the trapezoidal shape is reversed. Adjacent sections in the forward orientation can be placed side-by-side to form an angle to bring the side portions inward. A forward orientation and reverse orientation section can be placed side-by-side in a straight line position, which is useful, for example, for the center portion of the stage setup.

Several problems can occur with reconfigurable riser sections of this type. Since the step portions are removable, attaching and locking means must be provided for securing the step portions to the riser sections. In order to save time in setting up the risers, the locking means must be simple and quick to operate. At the same time, they must be very secure and positive in operation to minimize the possibility of a step not being properly secured, which of course would present a hazard to the persons subsequently using the riser.

It is also important to provide means for securing adjacent stage sections to one another in a stage setup so that they will not move or open up a gap as they are being mounted or dismounted by the persons who will use the riser. It is also important that this type of lock be simple to use and secure in its action, but this is complicated by the fact that the locking system must be workable regardless of whether adjacent stage sections are in forward or reverse configuration.

It is customary to provide a guardrail along the back of each stage section, so that persons standing on the top row cannot accidentally fall backward off the stage. The guardrail should of course be as wide as the step in the top or back position on the stage. However, when a stage section is converted for reverse configuration, as described above, a narrower step ends up at the top position of the stage section, and this means that the guardrail is much wider than the top step, so the sides of the guardrail will interfere with the sides of guardrails of adjacent sections. To overcome this problem, the prior art provided for disassembly and removal of the outer end portions of the guardrails when a stage section is in the reverse configuration. However, this is undesirable since it requires extra operations in setting up and taking down the stage and the possibility that the removed guardrail sections will not be put back on properly.

SUMMARY OF THE INVENTION

In order to overcome these and other problems in the prior art, we have provided an improved mobile folding choral riser.

According to the invention there is provided a portable riser section for use with a plurality of similar riser sections in order to make an extended riser for performances by singing groups and the like. The riser section includes a foldable frame for placement on a floor and having means for receiving and supporting a plurality of riser steps at progressively increasing heights above the floor from the front to the back of the frame. A plurality of riser steps are provided. The foldable frame includes a first support frame resting on a plurality of wheels and a second support frame foldable with respect to the first support frame and including at least a leg in front of the front wheels of the first support frame and a leg in back of the front wheels.

In one aspect of the invention, a pneumatic spring assembly is provided to assist folding of the second support frame with respect to the first support frame. Furthermore, the pneumatic spring provides a force which encourages the second support frame to stay in a transport configuration. When the second support frame is unfolded to the operational configuration, a locking mechanism is provided to retain it.

According to a further aspect of the invention, each of the plurality of riser steps may be locked in position on the receiving means of the frame by means of locks including retractable pins positioned to pass in locking holes or under support bars to hold a step in the use position. Resilient means are provided for normally urging the pins into locking position. In one embodiment, each pin has a reduced diameter section near its tip so that even if the step is not properly positioned on the frame so that the thick part of the pin will lock the step in position, then the reduced diameter portion of the pin will serve as a safety backup to prevent the step from coming off.

According to another aspect of the invention, a riser section is provided having steps of varying widths which can be interchanged to place the widest step at the back or the widest step at the front. A guardrail is carried on the frame of the riser section and extends along the back of the top riser step to serve as a safety support for persons using the riser The guardrail is secured to the frame of the riser in a manner to permit limited movement thereof in a direction towards the front of the riser, so that the edges of the guardrail can overlap the edge of a guardrail of an adjacent riser section when riser sections in reverse and forward configuration are placed side-by-side. Furthermore, in one embodiment of the invention the guardrail is pivotally mounted on upright members of the first support frame to allow it to pivot down for the transport configuration to engage and hold the second support frame in an over-center folded position for transport.

According to another aspect of the invention, means are provided for interlocking adjacent riser sections together, in one embodiment in the form of complementary locking means positioned on opposite sides of riser steps. The locking means are convertible between first and second types so that regardless of whether the steps are in forward or reverse orientation on the riser frame, the interlocking means can be adapted so that members of the appropriate first or second type are placed side-by-side to thereby lock adjacent riser sections together.

In another embodiment, the locking means between adjacent riser sections includes an extendable linkage mechanism having a rotatable connecting member which moves one end of a first link over center and past the nearest end of a second link to thereby tighten the linkage between connections on adjacent riser sections thereby holding the sections firmly together.

DETAILED DESCRIPTION OF THE PREFERRED EMBODIMENT

Figure 1:
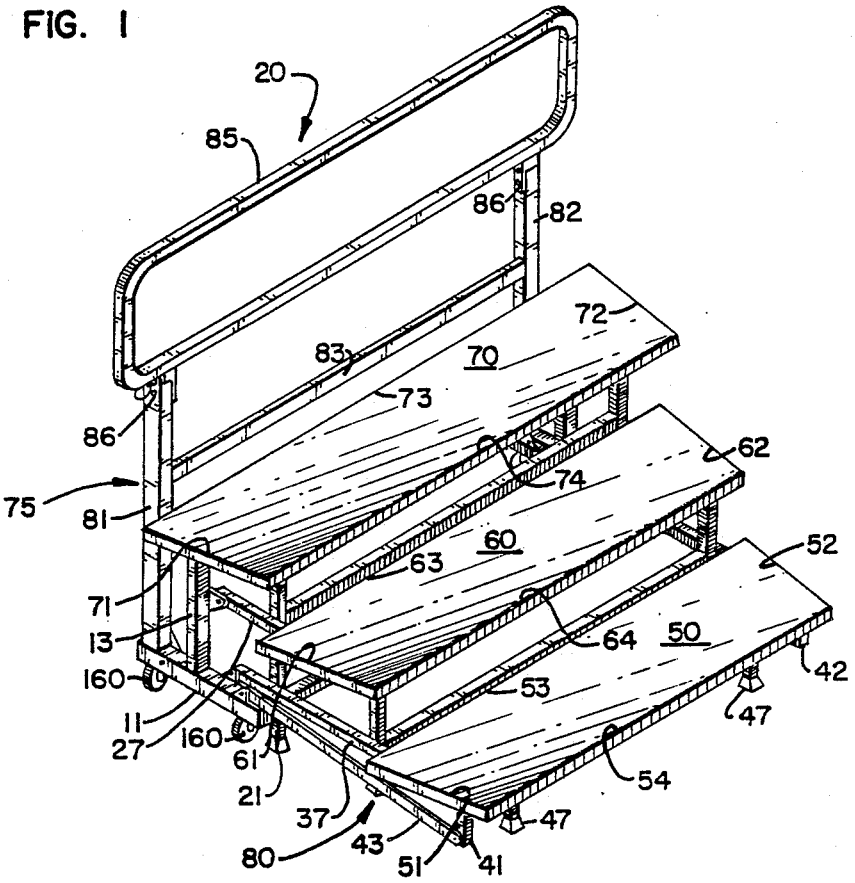
FIG. 1 is a view in perspective of a mobile folding choral riser according to a preferred embodiment of the present invention.

With reference to the various figures of the drawing, in which the same reference numbers indicate the same parts throughout, the mobile folding choral riser according to the present invention is seen generally to comprise a folding frame 10 including a first support frame 75 and a second support frame 80. First support frame 75 supports second support frame 80 in a transport configuration and shares with second support frame 80 the support of the load of performers in the operational configuration. First support frame 75 includes a back guardrail 20. Second support frame 80 receives a plurality of riser steps upon which the performers stand.

The preferred embodiment shows three steps identified as steps 50, 60 and 70, but it will be appreciated that any number of steps can be provided through suitable modifications and additions to the folding frame in accordance with the principles of the invention. Each of the steps 50, 60, 70 are generally flat members which may be made out of plywood or other suitable material, and each has slightly angled side portions so as to form a generally trapezoidal shape. For example, step 50 has angled edges 51 and 52 which connect from a longer edge 53 and a shorter edge 54 to form a trapezoidal shape. Step 60 similarly has a short edge 64 at the front, in the orientation of FIG. 1, longer edge 63 at the back, and angled sides 61, 62. In the same manner, step 70 has angled sides 71, 72 and straight sides 73, 74. The steps can be covered with carpet or any other suitable floor covering as is generally known.

Although the steps are of the same general shape, step 70 is slightly wider, step 50 is slightly narrower, and step 60 is of intermediate width. If four or more steps would be provided, each would have a length proportionate to its position on the riser. In the orientation of the riser of FIG. 1, step 50 is positioned at the lowest position, also referred to as the front position, and step 70 is at the top position, also referred to as the back position, with step 60 at the intermediate position. This orientation is referred to herein as the forward orientation. As is explained in greater detail below, the steps can be reversed in what is referred to as the reverse orientation, in which step 50 is at the top, step 70 is at the bottom, and all three steps are reversed end-from-end so that the angled sides angle inwardly toward the back of the riser section.

Figure 2:
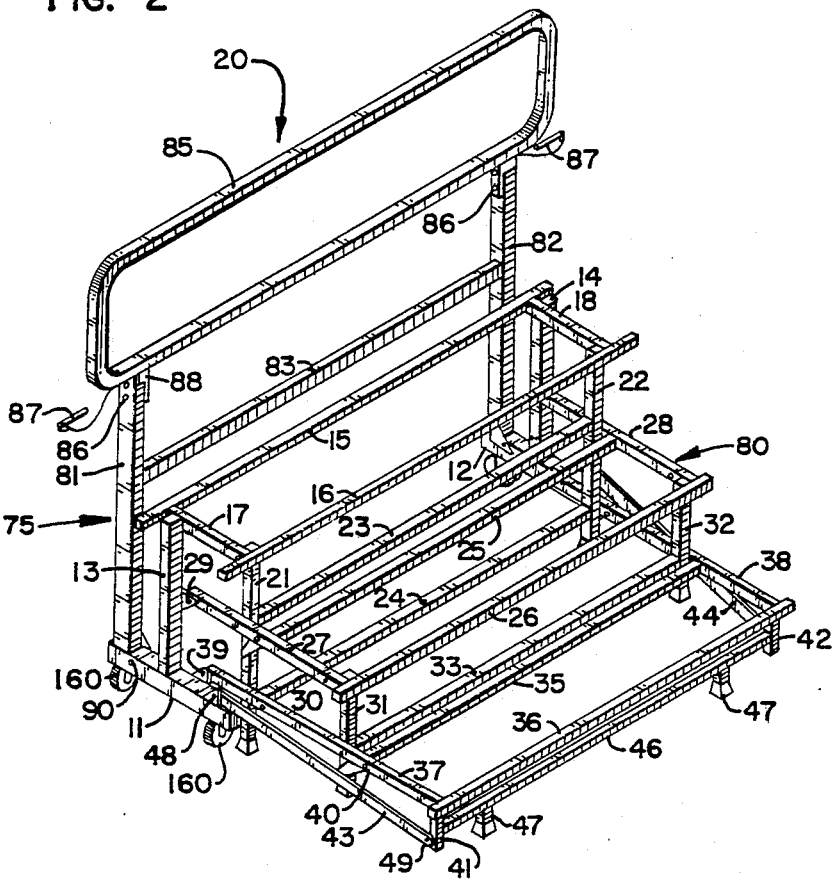
FIG. 2 is a view similar to FIG. 1 but with the riser steps removed.
Figure 3:
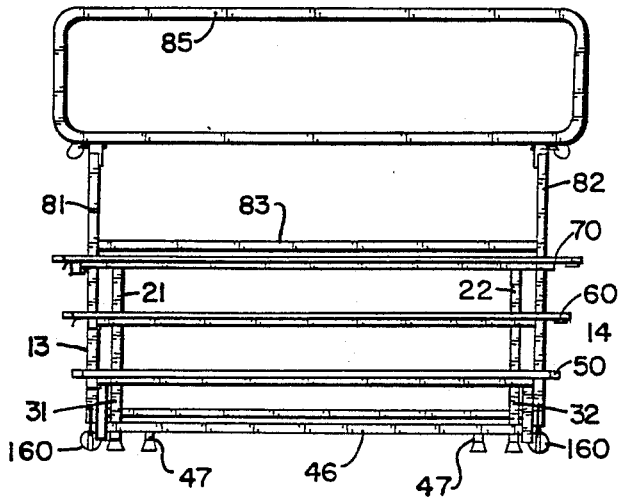
FIG. 3 is a front elevation view of the riser of FIG. 1.
Figure 5:
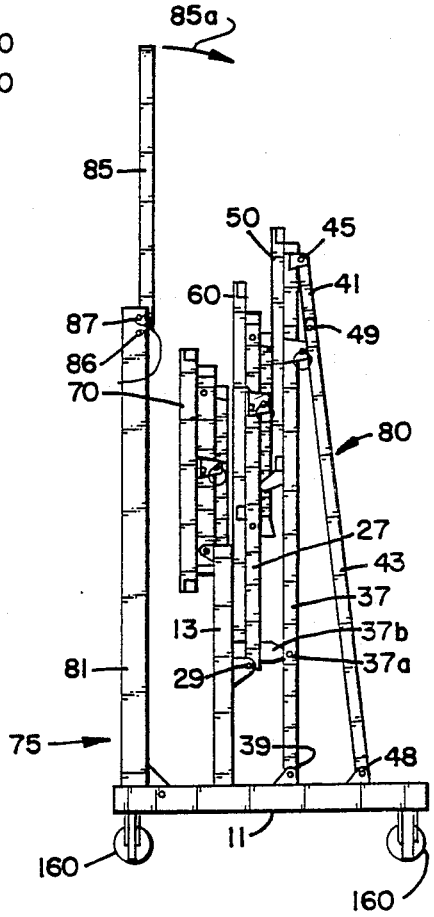
FIG. 5 is a view similar to FIG. 4 with the riser section in its folded position.
Figure 4:
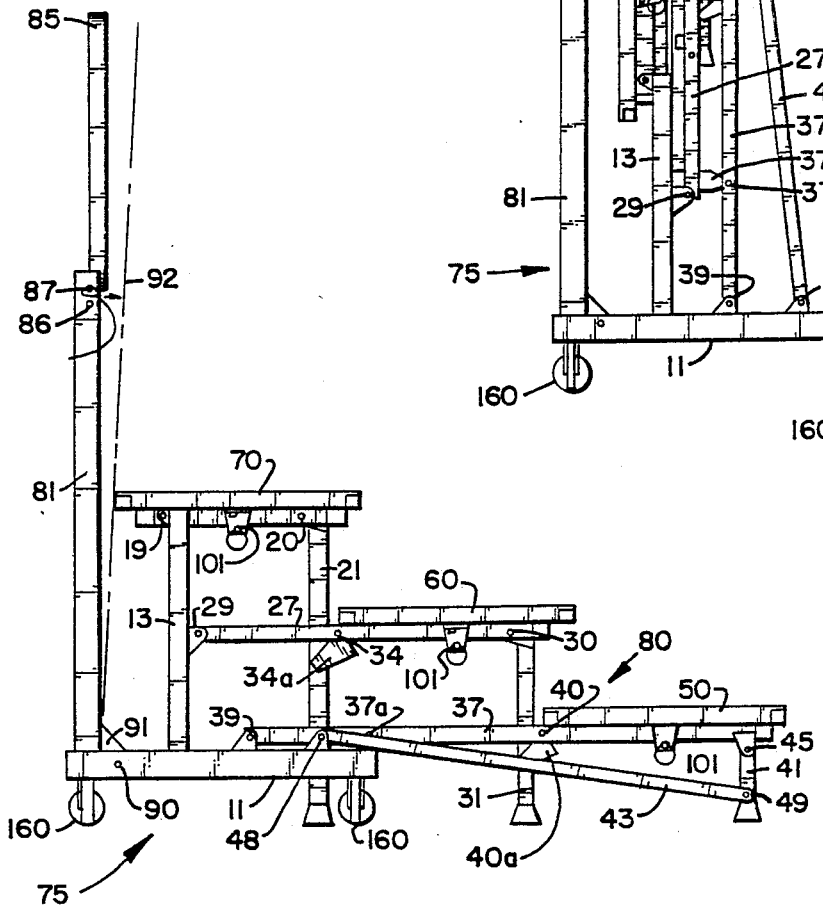
FIG. 4 is a side elevation view of the riser of FIG. 1, at a slightly enlarged scale.

As seen in greater detail in FIGS. 2, 4, and 5, the first support frame 75 includes a right base frame member 11 and a left base frame member 12. These members, as well as the other frame members to be described, are preferably made of rectangular-sectioned steel tube stock, although other materials and configurations can be used as is known in the art. Because the riser section is basically symmetrical, it will be appreciated that the frame elements visible in the drawings on the right side of the riser have corresponding mirror-image elements on the left-hand side of the riser.

Upright supports 13, 14 are secured, as by welding or the like, to base frame members 11, 12, respectively. With respect to second support frame 80, tubes 15, 16, 17, and 18 are secured together to form a rectangular support or receiving frame for the top riser step. Tubes 17 and 18 are pivotally connected adjacent their rearward ends to uprights 13, 14, respectively. This pivotal connection is indicated by reference number 19 in FIGS. 4 and 5, and can consist of bolts or pins through clearance holes in bars 17 and 18, and passing through tabs welded onto the uprights. The forward ends of tubes 17 and 18 are pivotally connected at 20 to uprights 21, 22 which extend downwardly to engage the floor in the use position of the riser. For this purpose they may have suitable rubber tips so as to not mar the floor surface. Uprights 21, and 22 are connected by lateral braces 23 and 24.

Tubular members 25, 26, 27 and 28 are connected together to define a rectangular support or receiving frame for the intermediate step position. Members 27 and 28 extend rearwardly of member 25 and are pivotally connected at 29 to uprights 13, 14, by means of tabs welded thereto for that purpose. At their forward ends, members 27, 28 are pivotally connected at pivots 30 to right and left uprights 31 and 32, which are connected by a lateral brace member 33 near their lower ends. These uprights also contact the floor and support some of the weight of the riser in its use position, and may be provided with rubber feet. Members 27, 28 also are pivotally connected to uprights 21, 22 by means of pivots 34 which connect through weld-on tabs, numbered **34*a* in FIG. 4**.

Tubular members 35, 36, 37 and 38 are secured together to form a support or receiving means for the lower riser step position. Members 37 and 38 extended rearwardlY of member 35 and are pivotally connected to base frame members 11, 12 at pivot 39. They are also pivotally connected to uprights 31, 32 at pivot 40, which also connects to a tab (40A in FIG. 4) welded to the upright. Member 37 is also pivotally connected at pivot **37*a* to a tab 37*b* (visible in FIG. 5) secured to upright 21, and member 38 and upright 22 on the other side of the riser are similarly connected. The forward portion of members 37, 38 are pivotally connected at pivot 45 to uprights 41, 42**.

A lateral brace 46 connects between uprights 41, 42. A pair of short legs 47 are secured to brace 46 and have rubber feet for engaging the floor. Links 43, 44 extend between base frame members 11, 12 and uprights 41, 42 respectively, and are pivotally connected thereto by pivots 48, 49.

At the rear of the riser section, the guardrail 20 includes uprights 81, 82 which are connected by a cross-support 83. The back guard portion 85 is connected to uprights 81, 82 and extends between them at approximately the height of the back of the persons who would be standing on the top section of the riser. Back guard 85 can take any shape, and in the preferred embodiment is in the form of a tubular member formed into a roughly rectangular shape with rounded corners. Also in the preferred embodiment, back guard 85 includes brackets which are attached to uprights 81, 82 by pivot pins 86 so that it can be moved forward and down to reduce the overall height of the riser section for shipping or storage purposes. This folding movement of back guard 85 is indicated by arrow **85*a* in FIG. 5. Cotterless hitch pins 87 with retaining cables are placed through holes in the brackets and uprights to hold the back guard in the use position. The brackets include tab portions 88 on their fronts so that the back guard can pivot only forwardly, not rearwardly, so that it will support a person who accidentally leans backwardly on it. It is noted that with a back guard 85 having a roughly rectangular shape as described and a pivotal movement to reduce the overall height of the riser section as described, that back guard 85 may be moved to encircle a portion of second support frame 80** to thereby hold it in the folded or transport configuration.

The lower ends of uprights 81, 82 are connected to base frame members 11, 12, respectively, to permit pivotal movement in a forward direction, that is, in a direction towards the front of the riser section.

The pivotal connection of upright 81 to base frame member 11 is best seen in FIGS. 4 and 5, and includes an angle tab 91 welded to the lower portion of upright 81 long the inside edge thereof, and a pivot pin 90 passing through tab 91 and frame member 11. The bottom of upright 81 rests on frame member in normal position as shown in FIG. 4 so that the guardrail cannot move to the back if someone leans on it from the riser step. However, the guardrail can move forward slightly to position indicated by dotted line 92 in FIG. 4. Only an inch or so of movement is needed for providing clearance for the guardrails of adjacent riser sections under certain circumstances as described in greater detail below. The limitation on the amount that the guardrail can move can be provided for by a tab or other stop mechanism in association with the pivot, or may be provided by the fact that the guardrail would contact the upper riser step or its support frame if moved too far. Preferably, pivot 90 is very tight so that the guardrail does not pivot freely, but only if it is deliberately pushed.

Figure 6:
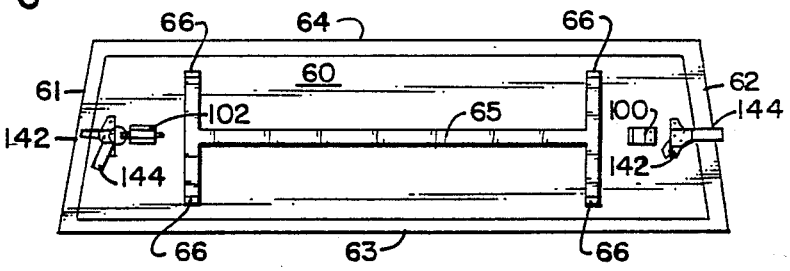
FIG. 6 is a view showing the underside of one of the riser steps.

Turning now to FIG. 6, the underside of one of the risers, for example, riser 60, is shown. As previously mentioned, the step can be made of any suitable material such as plywood and can be covered with carpet, and if so, the edge of the carpet can be wrapped around the edges of the step and tacked underneath. A reinforcing member 65 is provided in the form of tubular steel members welded into an H-shape and secured to the bottom of the step. Not only does this member 65 help to provide strength, but it also serves to position and locate the step on the folding framework. Specifically, the four ends 66 of the H-shaped support 65 fit between members 25, 26 of the folding frame when step 60 is placed thereon, thus serving to locate the step with respect to fore and aft movement.

Figure 7:
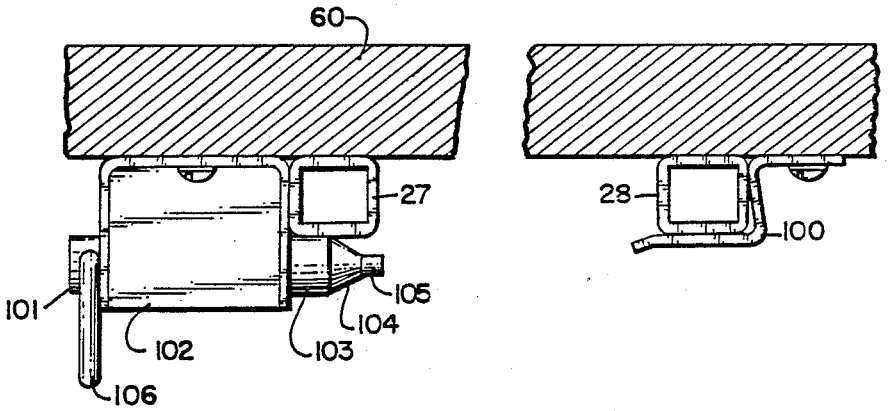
FIG. 7 is an enlarged fragmentary detail showing the locking means for holding the rise steps to the riser framework.

The step is secured to the framework by means of a latch mechanism shown in detail in FIG. 7. A bracket 100 is secured to the underside of step 60 and is formed in a shape to fit securely over member 28 of the folding frame. Adjacent the opposite end of step 60, a pin 101 is carried by housing 102 and is positioned so that pin 101 can pass beneath member 27 of the folding frame when the step is in position. Of course, since the step is reversible side-to-side, in the opposition orientation bracket 100 would fit over frame member 27, and pin 101 would fit under frame member 28. Housing 102 includes a bias spring (not shown) which normally urges pin 101 in a direction to secure the step as shown in FIG. 7. To remove the step, ring 106 in pin 101 can be manually pulled to retract the pin to allow the edge of the step to be raised up, after which the step can be moved to remove bracket 100 from frame member 28.

An important feature of the present invention is the stepped or tapered end of pin 101. Pin 101 has a diameter 103 which is designed, in conjunction with the height of housing 102, to snugly contact frame member 27 when 27 when step 60 is in place. This securely holds the step in place on the frame with no play or looseness. Towards the end, pin 101 tapers through a region 104 from the large diameter of section 103 to the narrower diameter of section 105. The purpose of this is to provide a safety backup in the event that the step is not properly seated during assembly. If the step 60 were not fully seated on the frame, for example due to inadvertence or inattention on the part of the assembly personnel, or due to debris caught between the frame and the step, pin 101 could not move to the lock position indicated in FIG. 7 because of interference between the large diameter portion 103 and frame member 27. In that case, however, because of the reduced diameter of section 105, pin 101 would still be able to move partway to the locking position. In that situation, the step might not be locked as securely as desired, but at least the reduced diameter portion 105 would catch beneath member 27 and prevent the step from accidentally tipping up and off as persons stand on the riser. Thus, the two-diameter shape of pin 101 provides its own safety backup system. It will be appreciated that each of the steps has a pin 101 and bracket 100 as described above.

Figure 8:
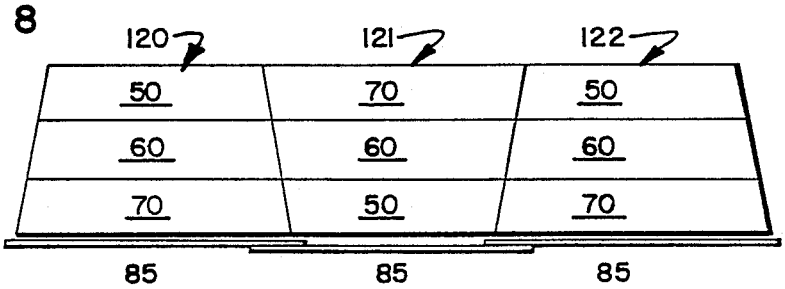
FIG. 8 is a schematic representation, in top plan, of three riser sections placed together in side-by-side relationship.
Figure 9:
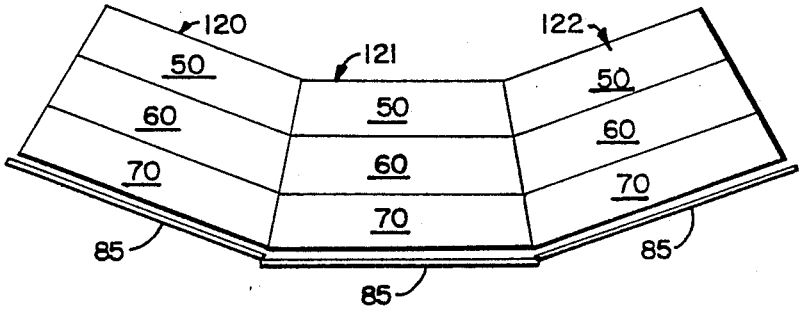
FIG. 9 is a view similar to FIG. 8 with the adjacent sections in angled relationship.

FIGS. 8 and 9 are schematic representations in top plan of three riser sections, 120, 121, 122, placed in side-by-side relationship to form an extended riser setup, or portion thereof. In FIG. 9, all three sections 120, 121, 122 are in the forward configuration, with their narrow steps 50 at the front and their wide steps 70 at the back, and the tapered sides tapering towards a narrower section at the front. This permits the sections to be positioned in angled relationship to one another. In FIG. 8, sections 120 and 122 are in the forward configuration, but section 121 is in the reverse configuration with its narrow step 50 at the top and its wide step 70 at the bottom. In addition, each of the steps 50, 60, 70 are reversed left to right so that the taper or angle of the sides angles toward a narrow dimension at the back of the riser. In this manner, adjacent riser sections can be placed side-by-side in a straight line configuration.

Since the width of the guardrail 20, and more specifically the back guard 85, should correspond to the width of the wide step 70, this creates a potential interference problem of the guardrails when riser sections in reverse and forward orientation are placed adjacent one another. Specifically, in the orientation of FIG. 9 the back guards 85 do not interfere, but in the orientation of FIG. 8 they do potentially interfere because of their width. However, in the present invention, in the case of the orientation of FIG. 8, the guard rails of some sections can be pivoted forward an inch or so that guard rails can overlap. The amount of overlap may be several inches, and is exaggerated in FIG. 8 for purposes of illustration. However, because of the interference, in the prior art it was necessary to have separate bolt-on outboard sections for back guards, which had to be disassembled and removed in order to place adjacent riser sections in the orientation of FIG. 8. That, of course, presented the possibility that the outboard sections would not be reinstalled when going to angled-type setup, resulting in a gap in guardrail coverage. However, with the present invention no disassembly or gap is involved, and the guardrail for one or the other of the adjacent sections is simply tilted forward to allow for the overlap.

The present invention also provides improved means for locking adjacent riser sections together when an extended riser setup is desired. For this purpose, locking means are provided along the edges of one or more of the riser steps. This interlock means can be used on the intermediate steps 60, or optionally also on the wide steps 70. It could also be used on the narrow steps 50, but it is believed that additional locks are not needed there, and the narrowness of step 50 provides less space for mounting of an interlock mechanism.

A complementary-type locking mechanism is used so that opposite edges of the steps 60 have the opposite types of mechanisms. For example, the preferred embodiment of the present invention uses complementary hook and eye members as the interlock, although other types of complementary latching members could also be used. For the orientation in FIG. 9, steps 60 would have their hooks along one edge and their eyes along their opposite edge so that the correct complementary locking members of adjacent stages would be positioned adjacent one another. However, in the orientation of FIG. 8, because step 60 on section 121 is reversed left to right, it would be necessary to reverse or interchange its locking means also (or those of the adjacent sections 120, 122) so that the correct complementary locking members will be adjacent one another. For this purpose, the present invention provides a locking means that can be quickly converted from one to the other type of the complementary locking means. In the preferred embodiment, this means that the lock can be converted from a hook-type to an eye-type as necessary.

Figure 10:
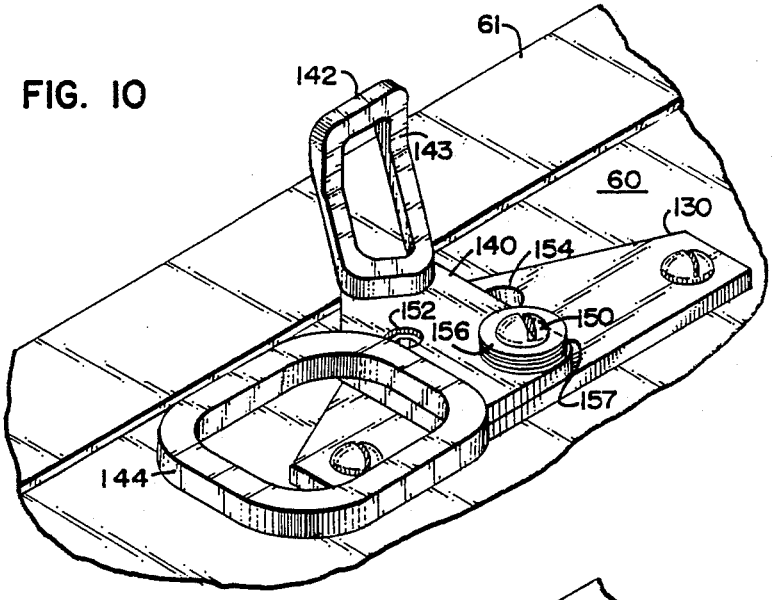
FIG. 10 is a fragmentary view at an enlarged scale of the underside of a riser step showing details of the locking means for securing adjacent riser sections.
Figure 11:
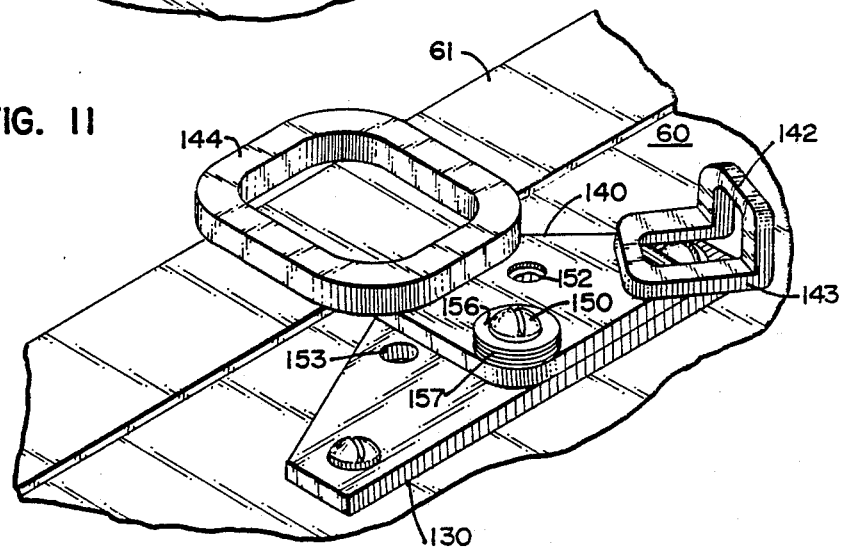
FIG. 11 is a view similar to FIG. 10 with the locking means in its opposite orientation.
Figure 12:
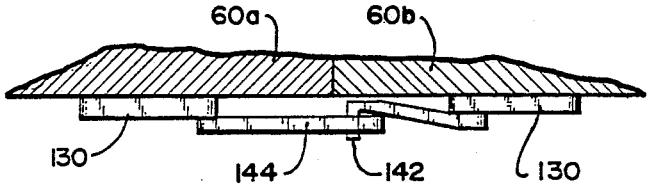
FIG. 12 is a fragmentary detail showing the operative connection of the locking means of FIGS. 10 and 11.

As seen in FIG. 6, 10 and 11, plates 130 are secured by suitable means, for example screws, to the underside of step 60 adjacent both edges 61 and 62 thereof. A locking means includes a plate 140 having a hook member 142 and an eye member 144 attached thereto along different sides thereof. The eye member 144 can be a piece of steel rod fashioned into a loop and welded to plate 140. Hook 142 can also be a loop of steel rod, but narrower than eye 144, and bent at 143 into a hook shape, so that it will fit within the eye 144 of an adjacent step. This is seen at FIG. 12, where two adjacent steps 60, labeled 60*a* and 60*b*, are positioned in edge-to-edge relationship and the hook portion 142 of step 60*b* is in engagement with eye portion 144 of step 60*a*. Since the steps themselves are secured to the folding frames of their respective riser sections, the riser sections are therefore secured together and prevented from moving apart under the shifting loads of personnel mounting or dismounting the riser.

Figure 13:
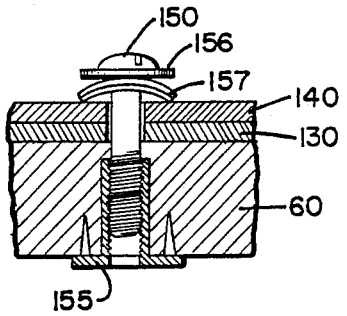
FIG. 13 is a sectional detail at an enlarged scale of a portion of the locking means of FIG. 10.

Any of the interlocks can be converted from hook to eye simply by pivoting plate 140. Specifically, plate 140 is secured to plate 130 by a machine screw 150 and a set screw 152. As seen in FIG. 13, machine screw 150 passes through plates 140 and 130 and is threaded into the threaded barrel of a T-nut 155 secured to the opposite side of the step member. A washer 156 and a pair of curved spring washers 157 are placed on machine screw 150 to help provide tension on plate 140. Set screw 152 passes through a hole in plate 140 and into either hole 153 or hole 154 of plate 130, depending upon the positioning of plate 140. To change positions, set screw 152 is backed out, plate 140 pivoted, and set screw 152 inserted. In this manner, the adjacent riser section interlock means can be converted as necessary when converting riser sections between forward and reverse orientation.

When the riser setup is no longer needed, adjacent sections can be uncoupled by tilting the sections or lifting their steps 60 to uncouple the hooks 142 from eyes 144. Individual sections can then be folded up to the position indicated in FIG. 5, where the various frame members and pivots previously described permit folding to a compact position with the riser steps still on the frame, and pivoted to vertical positions closely adjacent one another. As previously mentioned, back guards 85 can be pivoted forward and down to reduce the overall height. As an added feature, the geometry of link 43, upright 41 and pivot 49 (and the corresponding parts on the other side of the riser) are carefully chosen to provide a slight over-center resistance force which helps hold the riser in the folded position. This resistance force is achieved by careful dimensioning of the above-named points so that as pivot 49 passes through and slightly beyond a straight line between pivots 48 and 49, a slight resilient resistance is provided which is relaxed as the pivot 49 moves slightly beyond the center position, and this resilient force helps hold the mechanism up.

Another feature is that link 43, pivot 48 and the forward end of base frame member 11 (and the corresponding parts on the other side of the riser) are carefully designed so that in the use position as seen in FIG. 4, link 43 just contacts the corner of base frame member 11. This provides additional stability in that it prevents the portion of the frame including member 11, upright 13 and guardrail upright 81 from tilting or pivoting backward.

With the riser folded up, the legs are retracted and the entire section rests on caster wheels 160, which permit it to be wheeled away to a storage area. Wheels 160 are fastened to base frame members 11 and 12 with two in front of another two. All four caster wheels 160 can be swiveling, or alternatively two on one end can be fixed in lateral orientation as shown and the two at the opposite end can be pivoting. It is not necessary to provide brakes for the wheels, because in the use position a substantial portion of the weight of the riser and its load is on the various uprights and legs and not entirely on the wheels.

Figure 14:
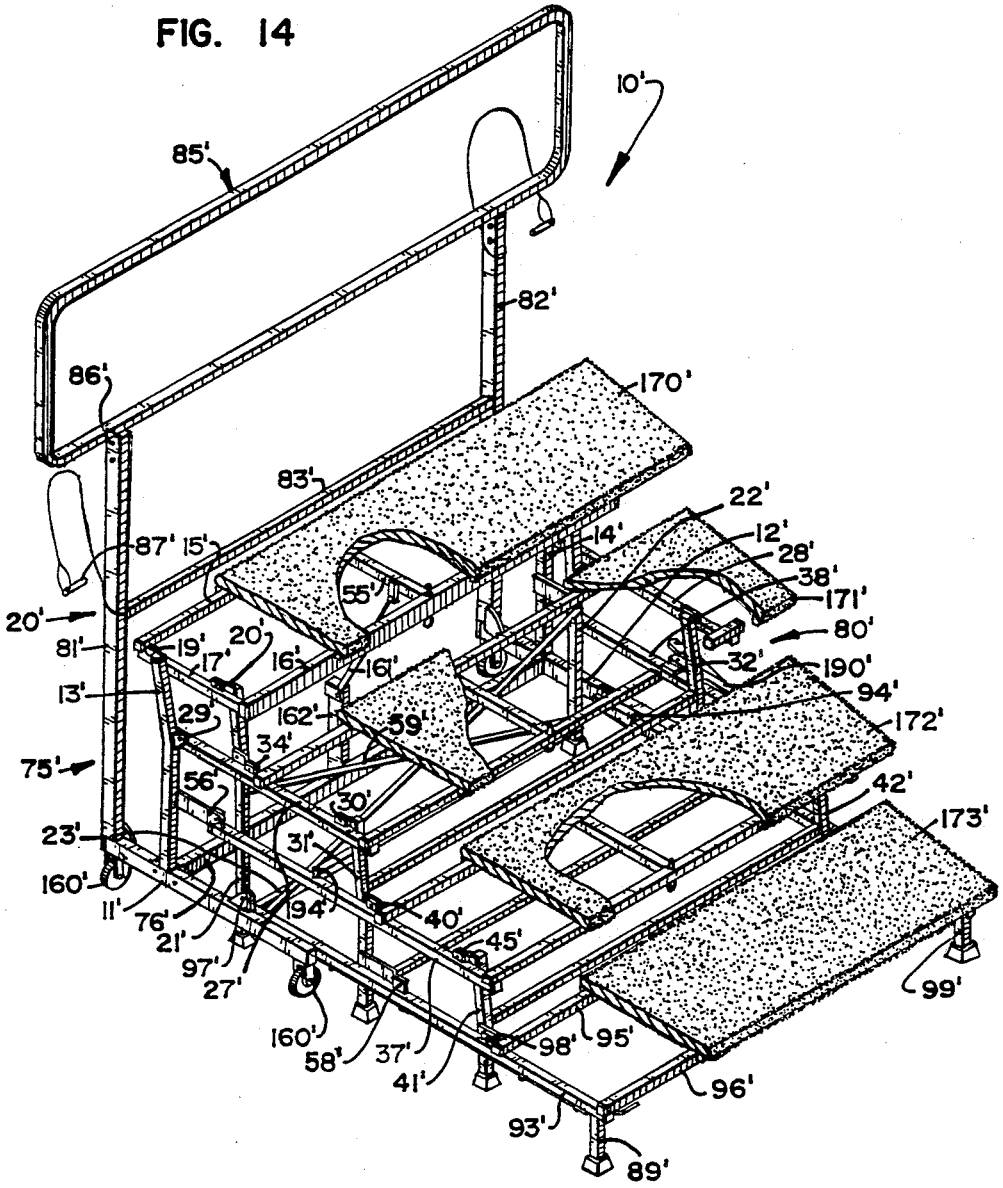
FIG. 14 is a view in perspective of a mobile folding choral riser according to another preferred embodiment of the present invention.
Figure 15:
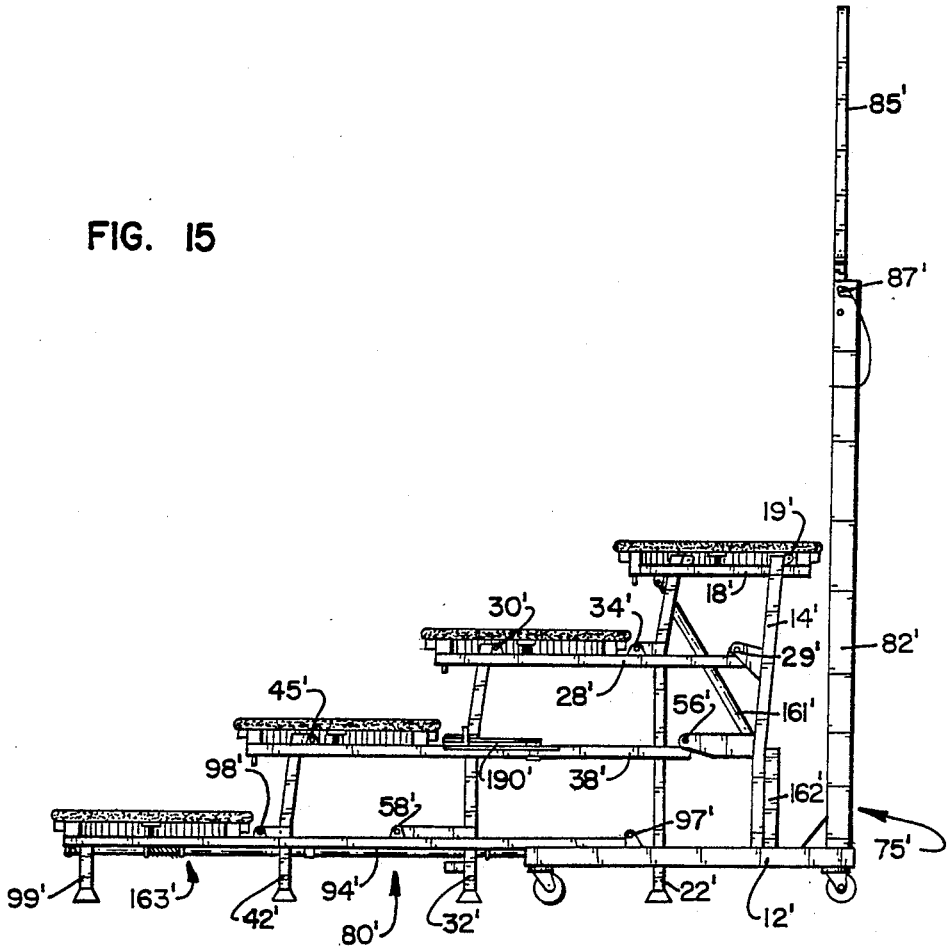
FIG. 15 is a side elevation view of the riser of FIG. 14 in an operational configuration.

In an alternate embodiment, similar parts are designated by the same reference numbers as used to describe the first embodiment, except the numbers are primed. In this regard, the alternate, but now more preferred, embodiment comprises as shown in FIGS. 14 and 15 a folding frame 10′ having a first support frame 75′ and a second support frame 80′. First support frame 75′ functions to support the riser section in the transport configuration, while in the operational configuration both first and second support frames 75′ and 80′ support the load of a performing group.

First support frame 75′ includes right and left base frame members 11′ and 12′ with a cross support 76′. Caster wheels 160′ are attached in a conventional fashion beneath base frame members 11′ and 12′. In this regard, there is a front caster wheel and a back caster wheel attached to each base frame member. Guardrail 20′ forms a part of first support frame 75′ and rises vertically from the back ends of base frame members 11′ and 12′. Guardrail 20′ includes uprights 81′ and 82′ with a cross support 83′. A back guard 85′ is connected to uprights 81′ and 82′ and extends between them at approximately the height of the back of the persons who would be standing on the top step of the riser section. As with the first embodiment, back guard 85′ is preferably formed in a roughly rectangular shape with rounded corners and includes brackets attached at pivot pins 86′ to uprights 81′ and 82′ so that it can be moved between an upright use position and a folded holding position. Hitch pins 87′ can be placed through holes in the brackets and uprights to hold the back guard in the use position.

Upright supports 13′ and 14′ rise from base frame members 11′ and 12′ at a location between the back and the midpoint of base frame members 11′ and 12′. Upright supports 13′ and 14′ provide a structure appropriately located to attach to second support frame 80′.

In the embodiment shown, second support frame 80′ can receive four riser steps, in contrast with the first described embodiment shown to receive three riser steps. It is understood that second support frame 80′ can be constructed based on the principles disclosed herein for any number of steps desired. With respect to second support frame 80′, tubes 15′, 16′, 17′, and 18′ are secured together to form a rectangular support or receiving frame for the top riser step 170′. A longitudinal tube 55′ extends between tubes 15′ and 16′ in the region of the midpoints of them. Lateral tubes 15′ and 16′ are attached to longitudinal tubes 17′ and 18′ so that the top surfaces of tubes 15′ and 16′ are elevated with respect to tubes 17′ and 18′. Tubes 17′ and 18′ are pivotally connected adjacent to the rearward ends of them to uprights 13′ and 14′, respectively. The pivotal connection is indicated by reference numeral 19′. The forward ends of tubes 17′ and 18′ are pivotally connected at 20′ to uprights 21′ and 22′, which uprights extend downwardly to engage the floor in the use position of the riser. For this purpose, uprights 21′ and 22′ may have suitable rubber tips. Uprights 21′ and 22′ are connected together by a lateral brace 23′.

The receiving frames for the rest of the steps are constructed similarly. Briefly, tubes 27′ and 28′ extend rearwardly for pivotal connection at 29′ to uprights 13′ and 14′, while having pivotal connections at pivots 30′ to uprights 31′ and 32′. Tubes 27′ and 28′ also are pivotally connected to uprights 21′ and 22′ at pivots 34′.

Tubes 37' and 38' extend rearwardly for pivotal connection to uprights 13' and 14' at pivotal connection 56'. At the front end, tubes 37' and 38' are pivotally connected at 45' to uprights 41' and 42'. Tubes 37' and 38' are also pivotally connected at 40' to uprights 31' and 32'.

Finally, the receiving frame for the lowermost step has longitudinally extending members 93' and 94' pivotally connected at the back end to base frame members 11' and 12' at 97'. Tubes 93' and 94' are also pivotally connected to uprights 41' and 42' at 98' and to uprights 31' and 32' at 58'. Uprights 89' and 99' extend downwardly from the front ends of tubes 93' and 94'. Laterally extending tubes 95' and 96' are attached between tubes 93' and 94' in a fashion as described earlier to provide a receiving frame for step 173'. A longitudinally extending center support (not shown) is provided in a consistent fashion.

Figure 17:
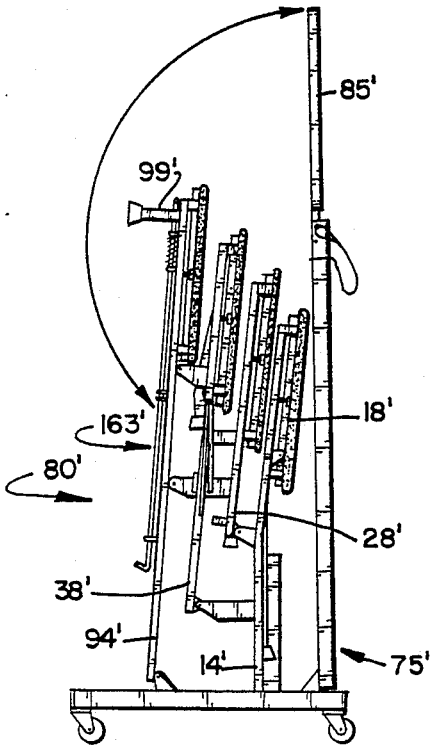
FIG. 17 is a side elevation view of the riser of FIG. 14 in a transport configuration.
Figure 18:
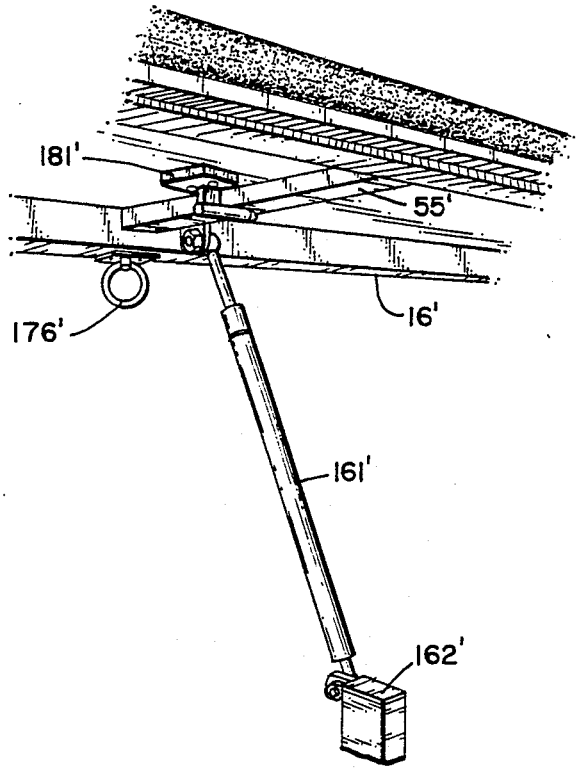
FIG. 18 is a detail view in perspective of the folding assist mechanism for the riser of FIG. 14.

The various pivotal connections are appropriately located to allow second support frame 80' to pivot from an operational configuration wherein the various longitudinally extending tubes 17' and 18', 27' and 28', 37' and 38', and 93' and 94' are substantially horizontal and substantially parallel with one another to a transport configuration as shown in FIG. 17 wherein each of the indicated tubes are moved somewhat beyond vertical. It is noted that such the movement over center creates a stable transport configuration for second support frame 80' with respect to support frame 75' and, with the further movement of back guard 85' over a portion of second support frame 80', particularly uprights 89' and 99' which do not fold, that second support frame 80' is safely positioned for transport. It is noted further that in the operational configuration second support frame 80' has a pair of front legs 89' and 99' which are forward of the front caster wheels of first support frame 75' and a pair of back legs 21' and 22' in back of the front caster wheels. In this way, the front and back legs and preferably those in between, as well as the wheels, share the support of the load of performers on the riser section during a performance.

A pair of diagonal members 59' cross one another and extend between uprights 21' and 22', preferably in a region beneath cross support 83'. Diagonal supports 59' function to laterally stabilize the first and second support frames 75' and 80' particularly when second support frame 80' is unfoled to the operational configuration.

A self-contained pneumatic piston and cylinder assembly 161' extends between centrally located, longitudinally extending tube 55' and an upright 162'. Upright 162' is fastened at its bottom to cross member 76' of first support fame 75'. Assembly 161' is representative of various types of spring devices capable of storing energy to aid in folding the second support frame 80' to the transport configuration. In this regard, it is understood that assembly 161' could extend between any portion of first and second support frames 75' and 80' and could be aided by additional such springs. Assembly 161' not only assists in the movement from the transport configuration to the operational configuration, but further aids in holding the riser section in the transport configuration.

Figure 22:
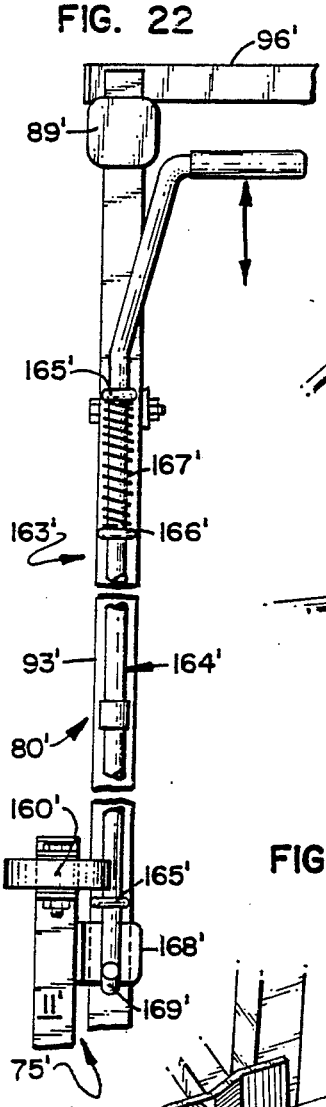
FIG. 22 is a bottom plan view of the mechanism locking in the operational configuration the foldable frame of the riser of FIG. 14.
Figure 23:
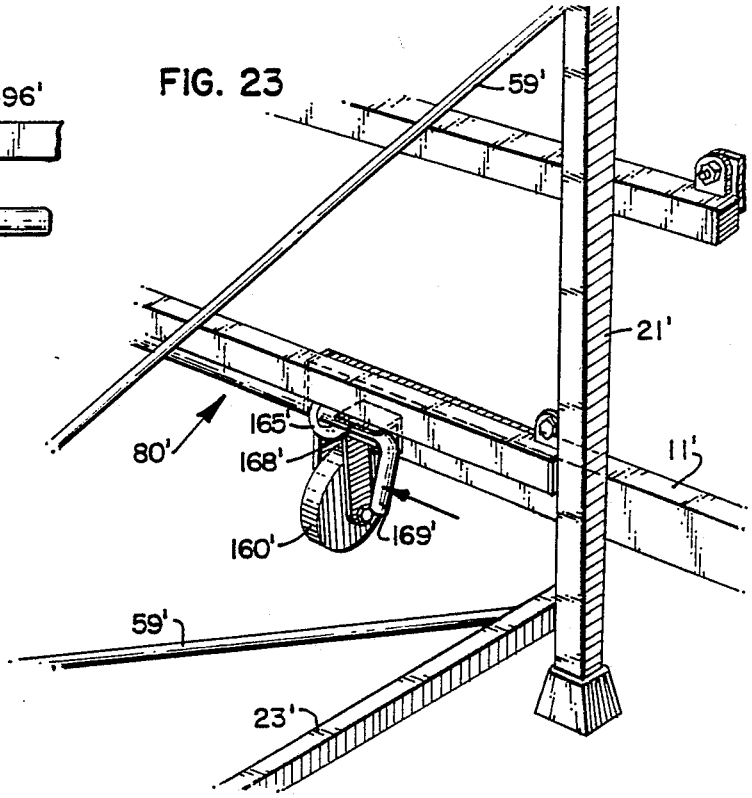
FIG. 23 is a detail view in perspective of an end of the locking mechanism of FIG. 22 engaging a stop so as to provide the locking function.

As shown in FIGS. 22 and 23, a mechanism 163' locks second support frame 80' in the operational configuration with respect to first support frame 75'. Mechanism 163' includes a rod 164' retained to the bottom side of member 93' by tabs 165' having appropriately sized holes therein. Rod 164' has a stop 166' fastened to it with a spring 167' which compresses when rod 164' is pulled forwardly to unlock. A stop member 168' is fastened to base frame member 11' extending inwardly toward the opposite base frame member. The back end 169' of rod 164' is bent downwardly so that as second support frame 80' is folded down from the transport configuration to the operational configuration, end 169' contacts stop member 168' and moves forwardly against the compression force of spring 167' until rod 164' at the radius of the bend passes underneath stop member 168' to interfere and lock second support frame 80' from folding to the transport configuration again without first releasing mechanism 163' from its locking position. In this regard, the front end of rod 164' is bent sidewardly to provide a handle for pulling against the compression force of spring 167' to release back end 169' from interference and locking against stop member 168'.

Figure 16:
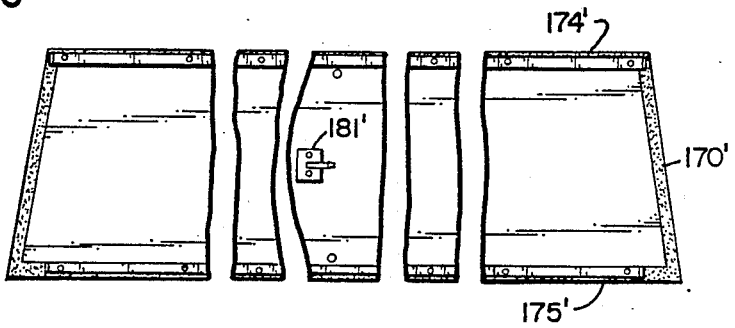
FIG. 16 is a fragmentary bottom plan view of a riser step for the riser of FIG. 14.

Steps 170', 171', 172', and 173' are constructed for mounting on the receiving frames of second support frame 80' as indicated hereinbefore. A representative step 170' is shown in FIG. 16. As described with respect to the first embodiment, a step may be made of any suitable material and may be covered with carpet. Step 170' of the present embodiment includes lateral tubes 174' and 175' at the front and back edges. Tubes 174' and 175' are spaced so as to just fit outside of, i.e. in front of and in back of tubes 16' and 15', of second support frame 80'. In this way, the tubes attached to the step and the tubes forming a part of the support frame all provide edge support for the step.

Figure 19:
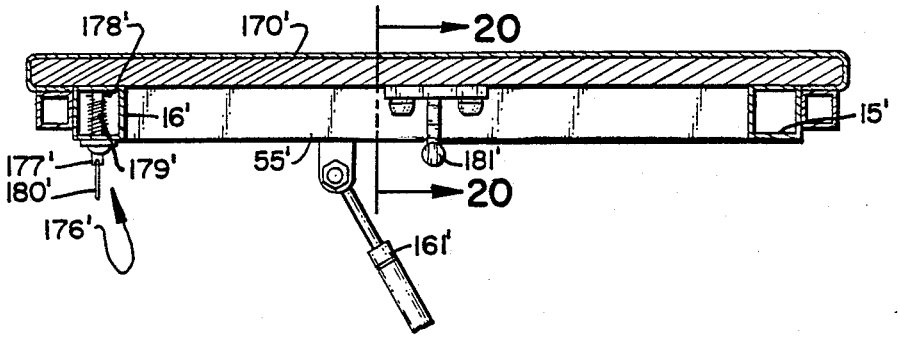
FIG. 19 is cross-sectional view of the top step of the riser of FIG. 14.
Figure 20:
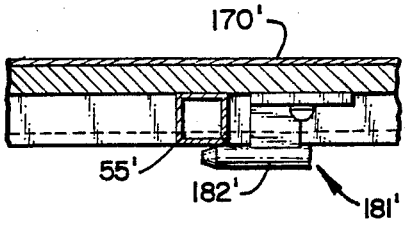
FIG. 20 is a view taken along line 20—20 of FIG. 19.
Figure 21:
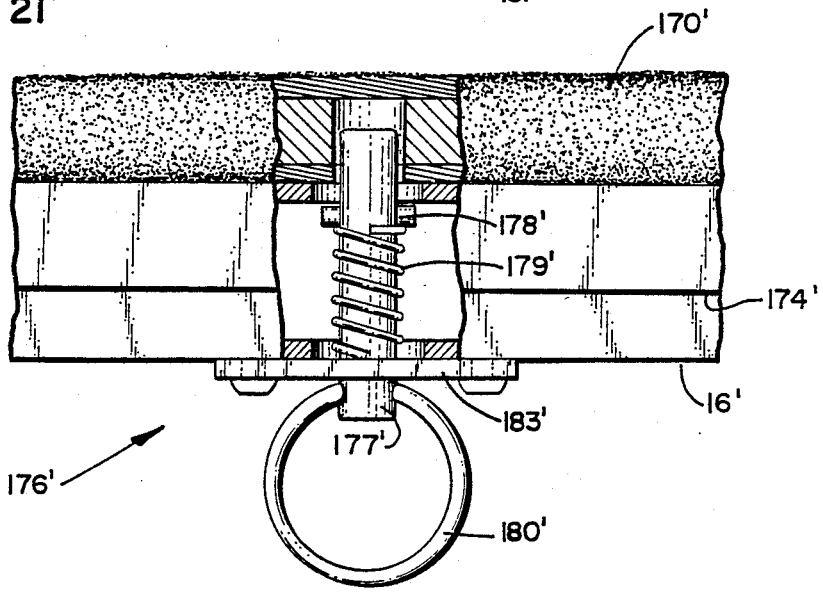
FIG. 21 is a fragmentary view at an enlarged scale of the retractable pin locking a step to the frame in the riser of FIG. 14.

Each step is secured to second support frame 80' with a locking or latch mechanism as shown in FIGS. 19–21. A retractable pin assembly 176' includes a pin 177' mounted in front lateral tube 16'. A spring 179' is received in compression on pin 177' between a plate 183' fastened to the bottom wall of tube 16' and a stop 178' on pin 177'. Pin 177' passes through openings in tube 16' and into a cavity in step 170'. Stop 178' prevents pin 177' from extending all the way into tube 16' or from being pulled from tube 16. Ring 180' or other similar item for easily grasping pin 177' is attached to the bottom of pin 177'. The top end of pin 177' normally extends into a cavity in step 170' and in that configuration provides a portion of the locking mechanism. When pin 177' is pulled downwardly to compress the spring 181', step 170' is released.

The other portion of the locking mechanism for step 170' comprises a bracket 181' attached to the underside of step 170' and having a portion 182' which fits underneath central tube 55'. Portion 182' is formed in the shape of a cylinder and has a tapered end so as to more easily be directed underneath tube 55' during the mounting of step 170'.

Figure 24:
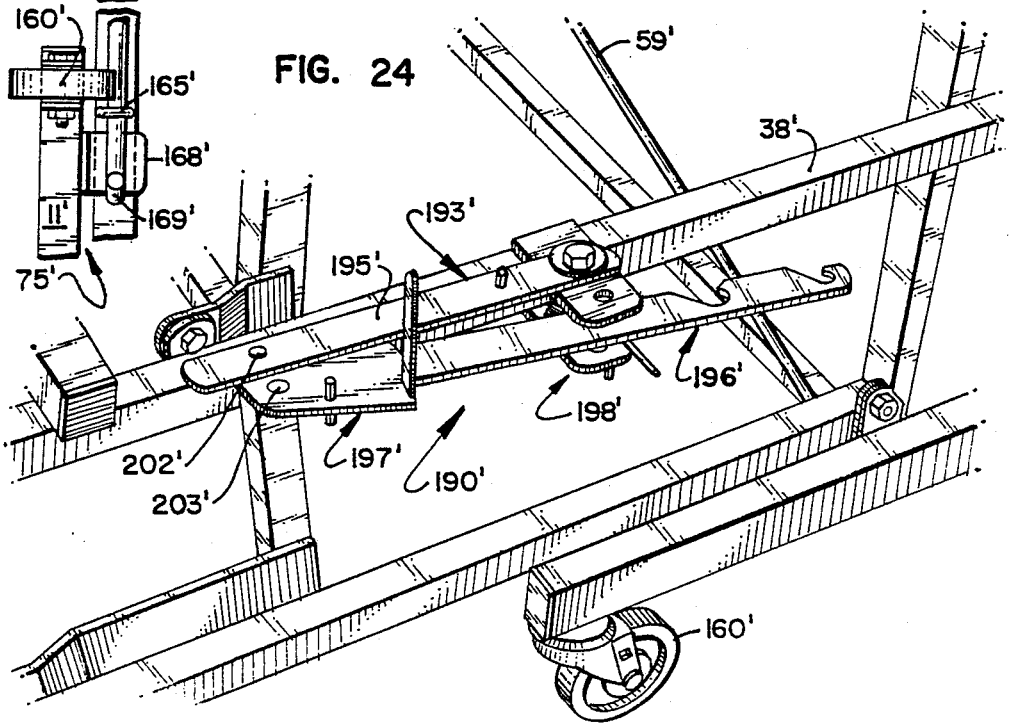
FIG. 24 is a perspective view of the mechanism for locking the frames of adjacent riser sections of the type shown in FIG. 14 together.
Figure 25:
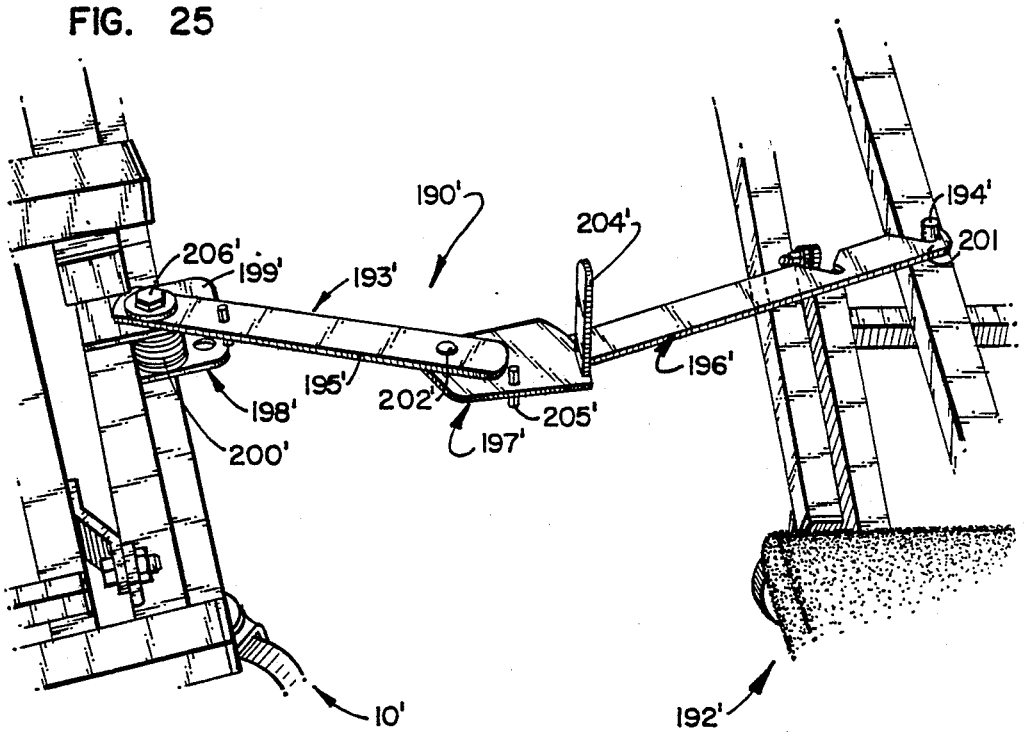
FIG. 25 is a view in perspective of the locking mechanism of FIG. 24 loosely connecting adjacent sections together.
Figure 26:
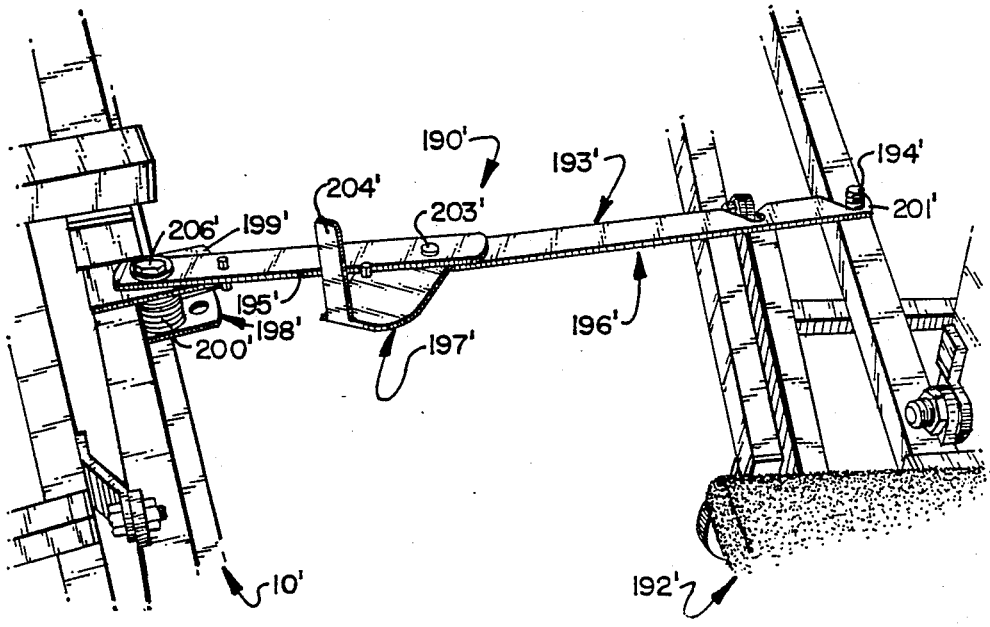
FIG. 26 is a view in perspective of the locking mechanism of FIG. 24 tightly securing adjacent sections together.

Mechanism 190' for interlocking an adjacent riser section 192' to section 10' is shown most clearly in FIGS. 24–26. Mechanism 190' includes linkage mechanism 193' attached to section 10' and a pin 194' attached to adjacent section 192'. Linkage mechanism 193' connects with pin 194' to snugly interlock the two sections together. It is understood that linkage mechanism 193' is ordinarily located on one side of a section while a pin 194' is located on the other side so that an adjacent section can be attached to either side of section 10'. As distinguished from the earlier described embodiment wherein an equivalent mechanism is attached to steps, mechanism 190' is attached in each case to the second support frame. Nevertheless, the steps are sized such that they are snugged together when mechanism 190' is tightened.

Linkage mechanism 193' includes a first end member 195' pivotally attached to section 10' and a second end member 196' with an intermediate member 197' therebetween. First end member 195' is pivotally attached with a nut and bolt combination 206' to a bracket 198' fastened to tube 38' of second support frame 80'. Bracket 198' has spaced-apart portions 199' such that a torsion spring 200' is retained on the bolt of combination 206' between portions 199'. One end of torsion spring 200' is fixed to bracket 198', while the other end is fixed to first end member 195'. Spring 200' functions to bias first end member 195' against member 38' of the second support frame 80' wherein mechanism 193' is not connected to pin 194'. In this regard, the unattached end 201' of second end member 196' is shaped as a hook for receiving pin 194'.

Intermediate member 197' is attached to first end member 195' at a first pivot 202', while second end member 196' is attached to intermediate member 197' at a second pivot 203'. Intermediate member 197' includes a handle 204' extending approximately perpendicular from the plane of the linkage members. Intermediate member 197' also includes a stop 205'.

Linkage mechanism 193' is shown in FIG. 24 in the transport configuration or in a configuration where it does not interlock with another riser section. In FIG. 25, interlock mechanism 190' is shown with linkage mechanism 193' hooked onto pin 194', but in a loose configuration. In FIG. 26, intermediate member 197' has been rotated by grasping handle 204' and moving second pivot 203' from one side of first pivot 202' to the other until stop 205' contacts first end member 195'. In that configuration, the steps of sections 10' and 192' contact one another so that the two sections are snug against one another.

In use, a riser section is conveniently moved on the caster wheels to a desired location. The back guard is pivoted so that it no longer encircles and holds the second support frame in the transport configuration. Nevertheless, the second support frame stays in the transport configuration because of the pneumatic spring and because the second support frame generally has its center of gravity moved beyond a vertical passing through its center of rotation. The second support frame is then unfolded from the transport configuration to the operational configuration. As the unfolding reaches completion, locking mechanism 163' snaps into the locked configuration.

Before interlocking one riser section with another, the steps of the various riser sections are arranged in what has previously been identified as a forward or a reverse orientation. As necessary, the steps are easily released by retracting the retractable pin and sliding the bracket having a portion fitting under a tube of the frame out from under such tube. The step is reversed so as to slide the portion under the tube from the opposite side and allow the retractable pin to engage the cavity in the step.

Riser sections are interlocked in either a straight line or an angled configuration as shown in FIGS. 8 and 9. The completed riser is then in an operational configuration ready for a performing group.

After a performance, the interlocking mechanisms are unlocked. The locking mechanism 163' for a particular section is unlocked and the second support frame is folded from the operational configuration to the transport configuration. Back guard 85' is pivoted down to encircle a portion of the second support frame thereby holding it in the transport configuration. The section is then ready for moving to storage.

In accordance with the principles outlined above and described with reference to the preferred embodiments, we have provided an improved mobile folding choral riser which can be quickly and efficiently set up in a variety of different configurations to form a secure extended riser for performances where needed, and which can be quickly and efficiently disassembled, folded and transported for storage.

What is claimed is:

1. A portable riser section for use with a plurality of other riser sections to make a riser above a floor for supporting a load during stage performances by singing groups and the like, comprising:

a plurality of riser steps;

a first support frame having a plurality of wheels;

a second support frame having means for receiving said plurality of steps at progressively increasing heights above the floor from front to back;

a leg supporting said second support frame; and means for connecting said first and second support frames and said leg to allow movement between transport and operational configurations such that in a transport configuration said leg is folded and said wheels of said first support frame support said second support frame and in an operational configuration said wheels of said first support frame and said leg of said second support frame share support of said load with respect to the floor, said connecting means including a member pivotally connected to said leg and to said first support frame, said leg being pivotally connected to said second support frame.

2. The portable riser section in accordance with claim 1 wherein said connecting means includes means for assisting movement between the operational configuration and the transport configuration.

3. The portable riser section in accordance with claim 2 wherein said assisting means includes a self-contained pneumatic piston and cylinder assembly.

4. The portable riser section in accordance with claim 1 wherein said second support frame includes means for laterally stabilizing said first and second support frames in the operational configuration.

5. The portable riser section in accordance with claim 4 wherein said lateral stabilizing means includes a first pair of upright members and a second pair of diagonal members which cross one another and extend between said upright members.

6. The portable riser section in accordance with claim 1 including means for locking said second support frame in the operational configuration with respect to the first support frame.

7. The portable riser section in accordance with claim 6 wherein said locking means includes a stop member on one of said first and second support frames and an interference member on the other of said first and second support frames, said locking means further including means for biasing said interference member into a locking relationship with said stop member.

8. The portable riser section in accordance with claim 1 including a guardrail positioned on said first support frame and extending along the back of the top riser step to serve as a safety support for persons standing on the top step, said guardrail extending substantially the width of the widest of said steps, said portable riser section further including means for securing said guardrail to said first support frame including means for moving in a limited fashion in a direction from back to front to permit said guardrail to avoid interference with an adjacent section.

9. The portable riser section in accordance with claim 8 wherein said guardrail includes means for holding said second support frame in the transport configuration with respect to said first support frame.

10. The portable riser section in accordance with claim 1 wherein said receiving means includes a plurality of bars supporting each one of said steps, said portable riser section further including for each of said steps means for locking said step to said plurality of bars, said locking means including a retractable pin retractably engaging said step and one of said bars and a bracket member attached to said step, said bracket member having a portion fitting underneath one of said bars.

11. The portable riser section in accordance with claim 10 wherein said retractable pin is positioned to pass under one of said bars and said portable riser section further includes means for normally urging said pin into position underneath the one bar and user-actuable means for manually retracting said pin to permit removal of the step from the second support frame, said pin having a main portion and near its tip a reduced thickness portion so that the reduced thickness portion of the pin will pass beneath the bar to prevent the step from coming off even if the step is not placed fully down on the bar so that the main portion of the pin can pass under the bar.

12. The portable riser section in accordance with claim 1 wherein said receiving means includes for each step a first pair of substantially parallel bars extending from one side of said second support frame to the opposite side, each of said steps including a second pair of substantially parallel bars attached to an under side of said step, one of said second pair fitting in front of said first pair and the other of said second pair fitting in back of said first pair when said step is received by said receiving means, thereby providing edge support for said step.

13. The portable riser section in accordance with claim 1 including means for interlocking an adjacent riser section thereto, said interlocking means including first and second elements which mate together to lock said adjacent sections together, said section including on opposite sides a different one of said first and second elements so that said adjacent section can be locked to either side.

14. The portable riser section in accordance with claim 13 wherein said riser steps have narrow, wide and intermediate widths and have tapered or angled sides so that each step is in generally a trapezoidal shape, said steps being mounted to said receiving means in a forward orientation with the wide step at the top, the narrow step at the bottom, and the intermediate step in between, with the tapered sides of all of the steps angling from a wide dimension at the back to a narrow dimension at the front of the riser, or in a reverse orientation with the wide step at the front, the narrow step at the back, the intermediate step in between and the angled sides angling from a wide front to a narrow back of the riser, so that a riser section in reverse orientation can be placed in side-by-side relationship with a riser section in forward orientation, said first and second elements of said interlocking means being identical and having first and second portions which on different ones of said elements mate with one another, said elements including means for switching so that said interlocking means can interlock with the complementary interlocking means of the adjacent riser section regardless of whether it is in said forward or said reverse orientation.

15. The portable riser section in accordance with claim 13 wherein said interlocking means includes means for linking said section to said adjacent section, said linking means being attached at one end to said section and having a hook at an opposite end, said interlocking means including a pin on said adjacent section for engaging said hook.

16. The portable riser section in accordance with claim 15 wherein said linking means includes a first end member attached to said section and a second end member with an intermediate member therebetween, said intermediate member being attached to said first end member at a first pivot and to said second end member at a second pivot, said intermediate member having a handle for rotating said second pivot from one side of said first pivot to the other to tighten said hook on said pin and to snug said section against said adjacent section.

17. A portable riser section for use with a plurality of other riser sections to make a riser above a floor for supporting a load during stage performances by singing groups and the like comprising:

a plurality of riser steps;

a first support frame having a plurality of front and back wheels;

a second support frame having means for receiving said plurality of steps at progressively increasing heights above the floor from front to back, said second support frame having a leg under each of said steps when said steps are received by said receiving means, said second support frame being foldable with respect to said first support frame such that in a transport configuration said first support frame supports said second support frame and in an operational configuration said legs of second support frame and said wheels of said first support frame share support of said load with respect to the floor; and means for pivotally attaching said second support frame to said first support frame such that said second support frame can be moved with respect to said first support frame between the operational and transport configurations;

means for locking in the operational configuration said second support frame with respect to the first support frame; and a guardrail holding in the transport configuration said second support frame with respect to said first support frame.

18. A method for using a portable riser section with a plurality of other riser sections to make a riser for stage performances by singing groups and the like, said riser section having first and second support frames, said second support frame supporting a plurality of riser steps at progressively increasing heights above the floor from front to back, said second support frame being foldable with respect to said first support frame between a transport configuration and an operational configuration, said first support frame including means for holding said second support frame in the transport configuration and further including means for locking said second support frame in the operational configuration, said method comprising the steps of:

moving said guardrail so that it no loner holds said second support frame with respect to said first support frame;

unfolding from the transport configuration to the operational configuration said second support frame with respect to said first support frame and locking the second support frame in the operational configuration;

after using said riser section for a performance, unlocking with said locking means said second support frame from said first support frames;

folding from the operational configuration to the transport configuration said second support frame with respect to said first support frame; and moving said guardrail so as to hold in the transport configuration said second support frame with respect to said first support frame.

19. The method in accordance with claim 18 including after the unfolding step the step of releasing said steps from said receiving means in order to move them from a forward orientation to a reverse orientation, said riser steps having narrow, wide and intermediate widths and tapered or angled sides so that each step is in generally a trapezoidal shape, said steps being mounted in the forward orientation with the wide step at the top, the narrow step at the bottom and the intermediate step in between, with the tapered sides of all the steps angling from a wide dimension at the back to a narrow dimension at the front of the riser, or in the reverse orientation with the wide step at the front, the narrow step at the back, the intermediate step in between and the angled sides angling from a wide front to a narrow back, said method further including then the step of rearranging said steps from one of the forward and reverse orientations to the other and locking said steps in said other orientation.

20. The method of using a portable riser section in accordance with claim 18 including after the unfolding step the step of interlocking said riser section with an adjacent riser section.

* * * * *

UNITED STATES PATENT AND TRADEMARK OFFICE

CERTIFICATE OF CORRECTION

PATENT NO. : 4,979,340

DATED : December 25, 1990

INVENTOR(S) : Kermit H. Wilson and Rollin D. Botts

It is certified that error appears in the above-identified patent and that said Letters Patent is hereby corrected as shown below:

Column 5, line 63, "rearwardlY" should be--rearwardly--.

Column 7, line 31, after "27" (first occurrence), delete--when 27--.

Column 8, line 13, after "so", insert--, so--.

Column 11, line 27, after "that", delete--such--.

Column 11, line 27, after "over", insert--the--.

Column 12, line 41, "16" should be--16'--.

Column 17, line 3, "loner" should be--longer--.

Signed and Sealed this

Second Day of June, 1992

*Attest:*

DOUGLAS B. COMER

*Attesting Officer*

*Acting Commissioner of Patents and Trademarks*